US005293011A

United States Patent [19]

Mokert

[11] Patent Number: 5,293,011

[45] Date of Patent: Mar. 8, 1994

[54] POWER LOCKOUT DEVICE

[75] Inventor: Dennis Mokert, Missoula, Mont.

[73] Assignee: Champion International Corporation, Stamford, Conn.

[21] Appl. No.: 970,812

[22] Filed: Nov. 3, 1992

[51] Int. Cl.[5] ..... H01H 9/28

[52] U.S. Cl. ..... 200/43.14

[58] Field of Search ..... 200/43.1, 43.14, 43.16, 200/43.19, 43.22, 327; 70/200, 212, 240, 30, 49, 18

[56] References Cited

U.S. PATENT DOCUMENTS

| | | | |
|---|---|---|---|
| 2,169,860 | 8/1939 | Von Hoorn | 200/43.22 X |
| 2,978,613 | 4/1961 | Hein | 200/43.11 X |
| 3,752,254 | 8/1973 | Carley et al. | 70/230 X |
| 4,098,099 | 7/1978 | Smith | 70/18 |
| 4,733,840 | 3/1988 | D'Amore | 70/18 X |

*Primary Examiner*—Renee S. Luebke

[57] ABSTRACT

The lockout device is intended for use on safety switches for controlling electric power equipment. It comprises a cable with a tip connected at one end. The tip is adapted to be threaded through holes on the actuators of safety switches. The tip has one or more openings for receiving padlocks to prevent removal of the cable from the switch actuators. The other end of the cable is constructed so that it is unable to pass through the actuator holes. This may comprise an enlargement at the end of the cable or the cable may be attached to the housing of the power equipment.

20 Claims, 2 Drawing Sheets

POWER LOCKOUT DEVICE

BACKGROUND OF THE INVENTION

1. Field of the Invention

This invention relates to safety switches for controlling electric power equipment, such as electric motor driven machinery, and more particularly to power lockout devices to prevent safety switches from being turned to the power on position when the equipment is being serviced.

2. Description of the Related Art

Before working on electric power equipment, such as electric motor driven machinery, it is necessary for safety to lock out the safety switch which controls the electric power fed to the equipment so that the power cannot be turned on and thus risk injury to the worker. Such safety switches are operated by a switch blade handle having a transverse lockout hole which, when the safety switch is off, aligns with a mating lockout hole affixed to the switch box. The worker inserts a padlock into the aligned lockout holes so that the switch cannot be turned on by anyone else.

When a worker wants to work on electrical equipment having many power sources, it is necessary for the worker to lockout each power source with a separate padlock. Thus the worker has to carry a number of padlocks together with a separate key for each lock.

That is especially burdensome for a motor control center having many motor switch boxes. For example, a motor control center can be four feet wide with 10 switches, and even as large as 40 feet wide with 40 switches. And each switch requires its own lockout padlock. Moreover, a number of workers can work on the same equipment with each having the need to lockout the equipment's power sources.

Thus, there was a long felt need for a more efficient way to simultaneously lock out a number of power sources, sometimes by a number of workers, especially for motor control centers with many safety switches.

SUMMARY OF THE INVENTION

It is a general object of the invention to provide a more efficient way to simultaneously lock out a number of power sources before working on electrical equipment.

A more specific object of the invention is to provide a lockout power device which can easily, simply and rapidly lock out a plurality of safety switches, especially in a motor control center.

A further object of the invention is to provide a lockout power device for a plurality of safety switches which can be used individually by a number of workers working on the same equipment, with each worker having complete control of the locked out power sources.

Briefly, in accordance with the invention, these and other objects are achieved by a power lockout device for safety switches comprising a cable having a needle-nosed tip at one end and a fastener at the other end coupled to the switch box. The diameter of the needle-nosed tip is smaller than the diameter of the lockout holes on the handles of the safety switches so that the tip and its attached cable can be threaded through the lockout holes of a plurality of safety switches. The tip has at least one opening through which the worker can mount a single padlock after threading through the lockout holes.

A feature of the invention is such a power lockout device with a plurality of openings in the needle-nosed tip, one for the padlock of each worker simultaneously working on the powered equipment.

Another feature of one embodiment of the invention is a power lockout device with its fastener in the form of a loop which rides on a guide bar mounted along the top front of the switch boxes so that in a wide motor control center, for example, the power lockout device can be slid along the front of the switch boxes to reach a sequence of safety switches at either end of the control center.

In accordance with another feature of the invention, a tip support rack is mounted along one or both sides of a control center. The tip support rack has a plurality of notches, each with a width larger than the diameter of the lockout cable and smaller than the diameter of its tip, to receive and support the tips of the power lockout devices when not in use.

For smaller control centers, in accordance with another embodiment of the invention, a similarly-notched tip support rack mounted at the top of the switch boxes receives and supports the tip of a plurality of power lockout devices, with the other cable end of each lockout device permanently fastened to the tip support rack.

A principle advantage of the invention is that one power lockout device can lock out many safety switches far faster than individual padlocks can, thus saving money by requiring less down time for repairs.

Another advantage of the invention is that fewer locks are needed with a consequent cost savings.

And last but not least, a major safety advantage of the invention is that a worker is able to lockout more switches that need to be locked out than the worker would with a limited number of padlocks.

Other objects, features and advantages of the invention will be apparent from the following description of the preferred embodiments when read in connection with the figures of the accompanying drawings.

DESCRIPTION OF THE PREFERRED EMBODIMENTS

Figure 1:
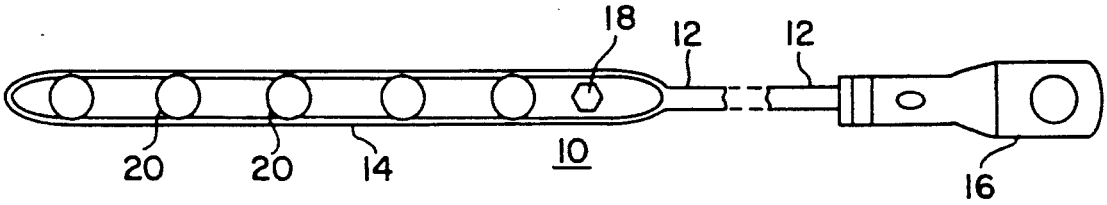
FIG. 1 is a plan view of a power lockout device in accordance with the best mode of the invention, with a plurality of openings along the length of a needle-nosed steel tip at one end of a plastic-covered cable, for padlocks of different workers, and a lug fastener at the other end for coupling to a motor control center. The intermediate length of the lockout cable has been broken away for purpose of convenience.

Referring to FIG. 1, a power lockout device 10 is shown consisting of a plastic coated aircraft cable 12 having a needle-nosed steel tip 14 at one end and a one-hole lug 16 at the other end. The cable 1 is secured to the tip 14 by a punch hole 18 part of the way through the tip 14. The tip 14 has five openings 20 for as many as five individual padlocks. And, if necessary, a multi lock device can be attached if more locks are needed.

The cable 12 is preferably ⅛" 7×19 galvanized plastic coated aircraft cable. The plastic coat is preferably red vinyl with a 3/16" outer diameter. The tip 14 is preferably ⅜"×4½" long. The inside end of the tip 14 preferably has a 13/64" hole to receive the cable. Each of the openings 20 is preferably 9/32" in diameter for a 13/64" shank padlock.

The cable 12 can be of any convenient length, for example 14'. And the number of openings 20 in the tip 14 can vary.

Figure 2:
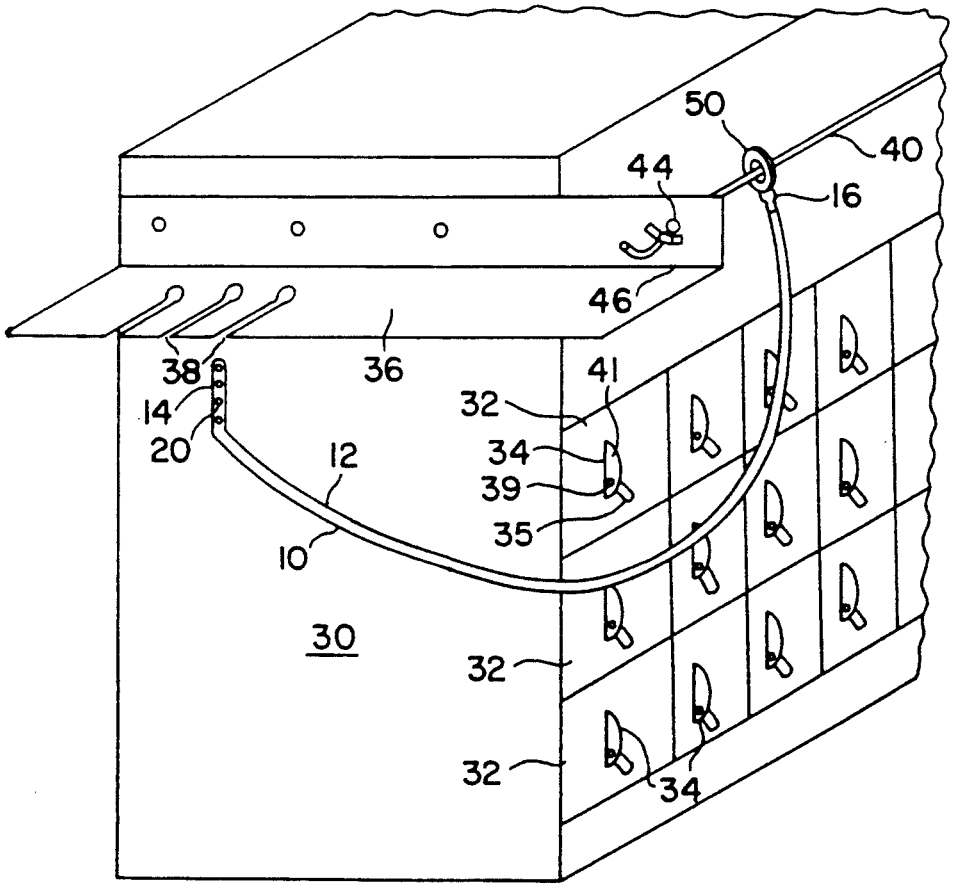
FIG. 2 is a perspective view of one end of a motor control center, partly broken away, having a plurality of switch boxes with a power lockout device having its fastener in the form of a loop which encircles a guide rod along the top front of the motor control center, and with its needle-nosed steel tip poised for support in a notched tip support rack mounted along the top left side of the motor control center.

The left portion of a motor control center 30 is shown in FIG. 2. The right portion of motor control center 30 is not shown for convenience. Motor control center 30 consists of a plurality of switch boxes 32, one per motor, fastened together with each switch box 32 having a safety switch 34. The number of switch boxes 32 depends on the power needed to run the motors in each area. As indicated above, motor control centers can be as little as 4' wide with 10 safety switches 34 or as long as 30' wide with 40 safety switches 34.

Each safety switch 34 has a switch handle 35 with a transverse lockout hole (not shown) which, when the switch 34 is in the off position, is aligned with a mating hole 39 in a semicircular plate 41 of the switch box 32.

The cable lockout device 10 in FIG. 2 is preferably 14' long.

A tip support rack 36 is bolted along the top left side of the motor control center 30. It consists of an angle iron preferably 3/16"×1½"×22". Tip support rack 36 has a plurality of hangers or notches 38 whose inner width is less than the outer diameter of needle-nosed steel tip 14 and larger than the outer diameter of cable 12.

Accordingly, when the tip 14 of a lockout device 10 is inserted above a notch 38, its cable 12 fits into the inner end of notch 14 with the tip 14 held above the notch 38 so that the lockout device 10 is easily and conveniently supported in the tip support rack 36.

A guide rod 40 is mounted along the top front edge of motor control center 30. The outer end of the guide rod 40 is mounted in a hole 44 at the inside end of tip support rack 36 with a split bolt connector 46.

The lug 16 opening holds a round chain link 50, preferably with a 3/16" diameter. Link 50 is slidably mounted along guide rod 40. This allows the power lockout device 10 to slide along in front of the motor control center 30 and to reach the safety switches 34 which need to be locked out. A larger motor control center 30 can have more power lockout devices 10. The notches 38 in tip support rack 36 are for holding the tip 14 of each power lockout device 10 along the side of the motor control center 30 when not in use.

In operation the power lockout device 10 is threaded through all of the safety switch lockout holes that need to be turned off and then each individual worker fastens his own padlock through one of the openings 20 of the tip 14.

Figure 3:
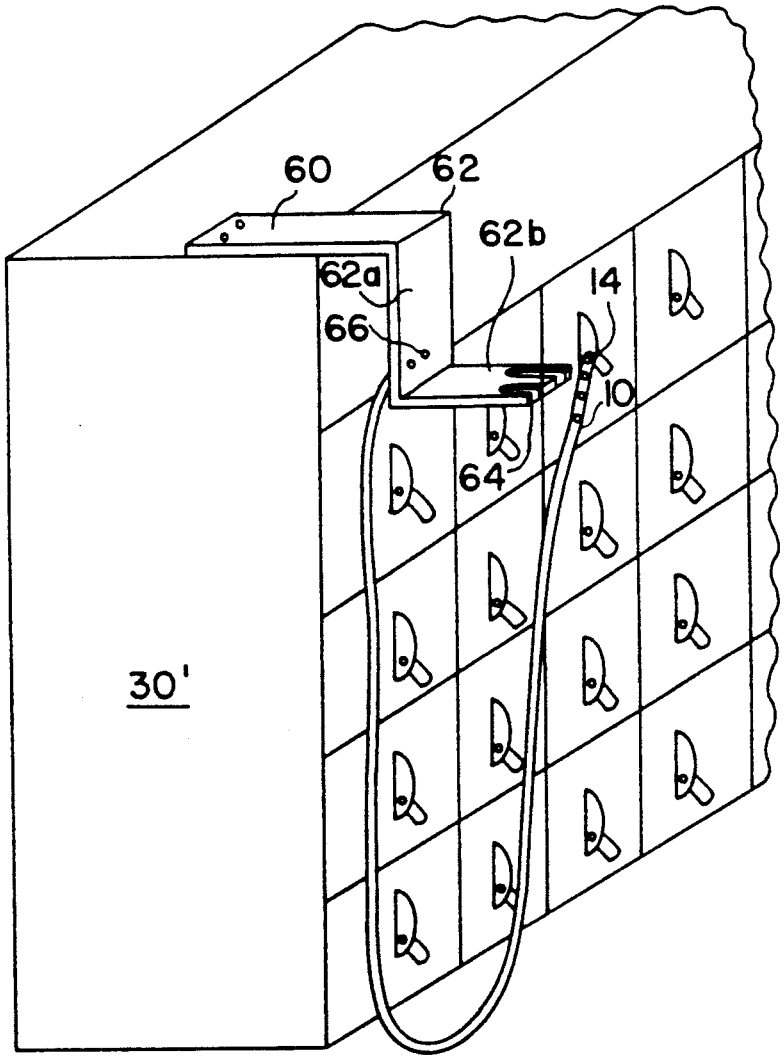
FIG. 3 is a perspective view of the embodiment of the invention in which a notched tip support rack is mounted at the top left front of the motor control center for receiving the tips of power lockout devices whose other ends are permanently fastened to the support rack.

FIG. 3 shows an alternative embodiment of the invention for smaller motor control center 30'. A tip support rack 60 is made from a flat metal strip 62 bolted on the top of the motor control center 30', bent down in front of the center 30 at section **62*a* and then bent outward at section 62*b*. Section 62*b* has a plurality of hangers or notches 64 whose inner width is less than the outer diameter of needle-nosed steel tip 14 and larger than the outer diameter of cable 12**.

The notches 64 in tip support rack 60 are for holding the tip 14 of each power lockout device 10 along the front of the motor control center 30' when not in use. The other end of each power locking device 10 is connected directly to the section **62*a* of the tip support rack 60 at 66**.

Accordingly, when the tip 14 of a lockout device 10 is inserted above a notch 64, its cable 12 fits into the inner end of notch 14 with the tip 14 held above the notch 64 so that the lockout device 10 is easily and conveniently supported in the tip support rack 60.

In still another embodiment of the invention, not disclosed in the drawing, a motor control center uses two 40' power lockout devices 10, one secured at each end of the motor control center. This allows one person starting from each side to thread each power lockout device 10 through the safety switches 34 and meet in the middle and lockout the tips 16 together.

While tip 16 is preferably made of steel it can be made of other materials such as plastic.

The inside end of each power lockout device is preferably slidably coupled to the motor control center (FIG. 2) or fixedly attached to it (FIG. 3) so that it is prevented from passing through the switch handle opening. But in still another embodiment of the invention, the inside end of power lockout device 10 is not coupled to the motor control center, but is simply enlarged enough so that it does not pass through the aligned holes in the safety switches 34. In FIG. 1, the enlargement is lug 16, which would float freely after the tip 12 and cable 14 were threaded through the lockout holes.

Other modifications of the invention which achieve some or all of its objects and attain some or all of its advantages are intended to be covered by the following claims.

I claim:

1. A power lockout device for a control center comprising a plurality of power source switch boxes each having a safety switch whose switch handle has a hole alignable with a matching hole on the switch box when the switch handle is in an off position comprising:

(A) a cable;

(B) a tip connected to one end of said cable adapted to be threaded through aligned holes of a sequence of safety switches in the power off position;

(C) said tip having a transverse opening adapted to receive a padlock; and (D) passage prevention means adjacent the other end of said cable adapted to prevent that end of said cable from passing through a switch handle hole;

(E) whereby said tip and connected cable can be threaded through a sequence of safety switch handles in the off position and a padlock is mounted in said transverse opening of said tip and locked so that each threaded safety switch cannot be switched from the off position.

2. A power lockout device according to claim 1 wherein said tip has a plurality of openings along its length each adapted to receive a padlock.

3. A power lockout device according to claim 1 wherein said passage prevention means comprises an enlargement adjacent said other end of said cable which cannot pass through a safety switch hole.

4. A power lockout device according to claim 1 wherein said passage prevention means comprises coupling means connected to the other end of said cable adapted to couple said cable to the control center.

5. A power lockout device according to claim 1 wherein said passage prevention means comprises coupling means connected to the other end of said cable adapted to slidably couple said cable to the control center.

6. A power lockout device according to claim 5 wherein said control center has a front and a rear face, power switch sources arranged on the front face of said control center and said coupling means comprises a guide support mounted across the front of said control center with said other end of said cable comprising a loop around and adapted to slide along said guide support.

7. A power lockout device according to claim 6 wherein said tip has a plurality of openings along its length each adapted to receive a padlock.

8. A power lockout device according to claim 1 further comprising a tip support rack mounted on the control center for supporting said tip when not in use.

9. A power lockout device according to claim 8 wherein said tip has a plurality of openings along its length each adapted to receive a padlock.

10. A power lockout device according to claim 8 wherein said tip support rack comprises a notch adapted to receive and support said tip.

11. A power lockout device according to claim 8 wherein said tip support rack comprises a notch adapted to support said tip at one end of said cable with said other end of said cable fastened to said tip support rack.

12. A power lockout device according to claim 8 wherein said tip support rack comprises a plurality of notches each adapted to support a tip at one end of a cable with the other end of the cable fastened to said tip support rack.

13. A power lockout device according to claim 12 wherein said tip has a plurality of openings along its length each adapted to receive a padlock.

14. A power lockout device according to claim 1 wherein said tip has a punch hole to fasten said cable within said tip.

15. A power lockout device for a control center comprising a plurality of power source switch boxes each having a safety switch whose switch handle has a hole alignable with a matching hole on the switch box when the switch handle is in an off position comprising:

(A) a cable;

(B) a tip connected to one end of said cable adapted to be threaded through aligned holes of a sequence of safety switches in the power off position;

(C) said tip having a transverse opening adapted to receive a padlock;

(D) whereby said tip and connected cable can be threaded through a sequence of safety switch handles in the off position and a padlock is mounted in said transverse opening of said tip and locked so that each threaded safety switch cannot be switched from the off position.

16. A power lockout device according to claim 15 wherein said tip has a plurality of openings along its length each adapted to receive a padlock.

17. A power lockout device according to claim 16 further comprising a tip support rack mounted on the control center for supporting said tip when not in use.

18. A power lockout device for a motor control center comprising a plurality of power source switch boxes each having a safety switch whose switch handle has a hole alignable with a matching hole on the switch box when the switch handle is in an off position comprising:

(A) a plastic coated cable;

(B) a needle-shaped steel tip connected to one end of said plastic coated cable adapted to be threaded through aligned holes of a sequence of safety switches in the power off position;

(C) said needle-shaped steel tip having a transverse opening adapted to receive a padlock; and (D) coupling means connected to the other end of said plastic coated cable for coupling said cable to the motor control center;

(E) whereby said needle-shaped steel tip and connected cable can be threaded through a sequence of safety switch handles in the off position and a padlock is mounted in said transverse opening of said tip and locked so that each threaded safety switch cannot be switched from the off position.

19. A power lockout device according to claim 18 wherein said needle-shaped steel tip has a plurality of openings along its length each adapted to receive a padlock.

20. A power lockout device according to claim 19 further comprising a tip support rack mounted on the motor control center for supporting said tip when not in use.

* * * * *